US011478831B2

(12) United States Patent
Shen et al.

(10) Patent No.: US 11,478,831 B2
(45) Date of Patent: Oct. 25, 2022

(54) MECHANICAL HIGH SPEED ROLL CHANGE SYSTEM FOR USE WITH ROBOTIC ROLL CHANGE SYSTEM

(71) Applicant: Primetals Technologies USA LLC, Alpharetta, GA (US)

(72) Inventors: William Shen, Boylston, MA (US); Matthew Palfreman, Charlton, MA (US)

(73) Assignee: Primetals Technologies USA LLC, Alpharetta, GA (US)

( * ) Notice: Subject to any disclaimer, the term of this patent is extended or adjusted under 35 U.S.C. 154(b) by 49 days.

(21) Appl. No.: 16/808,763

(22) Filed: Mar. 4, 2020

(65) Prior Publication Data

US 2021/0276062 A1 Sep. 9, 2021

(51) Int. Cl.
*B21B 31/10* (2006.01)
*B21B 1/16* (2006.01)

(52) U.S. Cl.
CPC ..... *B21B 31/10* (2013.01); *B21B 1/16* (2013.01)

(58) Field of Classification Search
CPC ..... B21B 31/10; B21B 1/16; B21B 31/103; B21B 31/08; B21B 31/106; B21B 31/12; B21B 31/14; B21B 31/02; B21B 31/078
USPC ..... 72/252.5
See application file for complete search history.

(56) References Cited

U.S. PATENT DOCUMENTS 3,995,356 A * 12/1976 Sheppard ..... B23P 15/16 29/890.128
4,685,390 A 8/1987 Pav et al.
4,881,310 A * 11/1989 Wykes ..... B21B 27/035 492/1
4,949,568 A 8/1990 Poloni
5,144,828 A 9/1992 Grotepass et al.
5,274,956 A 1/1994 Figge et al.
5,461,896 A 10/1995 Abbey, III et al.
5,524,469 A 6/1996 Sherwood
5,657,529 A 8/1997 Bohn et al.
5,862,699 A 1/1999 Lestani et al.
5,946,783 A 9/1999 Plociennik et al.
5,950,477 A 9/1999 Matsunaga
6,092,492 A 2/2000 Muller et al.
6,240,763 B1 6/2001 Benedetti
(Continued)

FOREIGN PATENT DOCUMENTS

CN 103084444 A 5/2013
DE 2639543 A1 3/1978
(Continued)

OTHER PUBLICATIONS

EP1378298 Eldridge (May 31, 2003) (Year: 2003).*
International Search Report and Written Opinion dated May 26, 2021 in related PCT/US2021/020393.

*Primary Examiner* — Adam J Eiseman
*Assistant Examiner* — Fred C Hammers
(74) *Attorney, Agent, or Firm* — Gesmer Updegrove LLP

(57) ABSTRACT

A roll mounting system is provided that includes a roll assembly coupled to one or more rolls. The roll assembly is configured to position the one or more rolls using a tapered assembly for mounting or dismounting of the one or more rolls. Also, the roll mounting system includes a torque assembly coupled to the roll assembly. The torque assembly is configured to provide torque to the roll assembly for mounting or dismounting of the one more rolls.

16 Claims, 10 Drawing Sheets

(56) References Cited

U.S. PATENT DOCUMENTS

| | | | | |
|---|---|---|---|---|
| 6,450,693 | B1 * | 9/2002 | Fuchs | B21B 27/03 384/538 |
| 6,460,390 | B1 | 10/2002 | Compagnoni et al. | |
| 7,082,800 | B1 * | 8/2006 | Muller | B21B 31/08 72/237 |
| 7,784,316 | B2 | 8/2010 | Witschas | |
| 8,215,146 | B2 | 7/2012 | Shore | |
| 8,555,688 | B2 | 10/2013 | Blecher | |
| 2002/0103062 | A1 * | 8/2002 | Wojtkowski, Jr. | F16C 13/02 492/48 |

FOREIGN PATENT DOCUMENTS

| | | | | |
|---|---|---|---|---|
| EP | 262039 | A1 | 3/1988 | |
| EP | 455082 | B1 | 6/1994 | |
| EP | 694345 | B1 | 9/1999 | |
| EP | 0979687 | A1 | 2/2000 | |
| EP | 1378298 | A2 * | 1/2004 | B21B 27/035 |
| EP | 432532 | B2 | 3/2004 | |
| GB | 1033032 | A | 2/1962 | |
| JP | 049312 | A | 3/1988 | |
| JP | 053709 | A | 3/1989 | |
| JP | 115908 | A | 5/1993 | |
| JP | H0661302 | U | 8/1994 | |
| JP | 292913 | A | 10/1994 | |
| JP | S6349312 | A | 3/1998 | |
| WO | 9416839 | A1 | 4/1994 | |
| WO | 2010049161 | A2 | 5/2010 | |
| WO | 2010049162 | A1 | 5/2010 | |
| WO | 2010089114 | A1 | 8/2010 | |

* cited by examiner

MECHANICAL HIGH SPEED ROLL CHANGE SYSTEM FOR USE WITH ROBOTIC ROLL CHANGE SYSTEM

BACKGROUND OF THE INVENTION

The invention relates to the field of wire rod rolling with cantilevered rolling stands. Rolls are currently changed manually by operators, for either quality-related issues or when the mill needs to change rolls due to roll wear or to produce another product size. The average change time per stand manually is in the region of 20 min; the most experienced operators can change a stand in 12 min. Rolls with sleeves can be as heavy as about 31 kg and the high-pressure hydraulic tools used to mount and dismount the rolls are more massive in some cases. The weights can exceed the allowable lifting limits and must be mounted from cranes and or manipulators, which further complicate the process of changing a roll. There is, of course, the risk of injury from trapping hazards and burns from hot equipment while changing the rolls on the machines.

SUMMARY OF THE INVENTION

According to one aspect of the invention, there is provided a roll mounting system. The roll mounting system includes a roll assembly coupled to one or more rolls, where the roll assembly is configured to position the one or more rolls using a tapered assembly for mounting or dismounting of the one or more rolls. Also, the roll mounting system includes a torque assembly coupled to the roll assembly, where the torque assembly is configured to provide torque to the roll assembly for mounting or dismounting of the one or more rolls.

According to another aspect of the invention, there is provided a method of performing the operations of a roll mounting system. The method includes positioning the one or more rolls into a roll assembly. The roll assembly is configured to position the one or more rolls using a tapered assembly for mounting or dismounting of the one or more rolls. The torque assembly is configured to provide torque to the roll assembly for mounting or dismounting of the one or more rolls.

DETAILED DESCRIPTION OF THE INVENTION

The disclosure describes a mechanical roll change system for use with robotic or otherwise assisted roll change system. The disclosure solves the problem associated with mechanically changing rolls on cantilevered rolling mill stands. The use of high pressure hydraulics is eliminated, which reduces the weight and complexity of the tooling system. Moreover, multiple tools, (i.e. roll handling, roll mounting and roll removal tools) are not required in some embodiments. With the capability of a new roll mounting and dismounting system to be integrated as an end effector to commercially available manipulators or 6 axis robots, manual removal and mounting of rolls is thus no longer required. Roll change can now be achieved automatically. In some embodiments, the novel roll mounting arrangement eliminates problems with part failures and increases the load-carrying capacity of the rolling mill stand.

The roll mounting system includes a roll, a spring, a tapered sleeve, a tapered sleeve removal and torque isolation ring, and a locking/unlocking nut. In order to mount a roll with the system, the roll assembly as described below is presented to a pinion by a manipulator or robot with an attached roll mounting system. Once located correctly, the roll mounting system drives the locking and unlocking nut in the correct direction via a torque drive to push a tapered sleeve between the roll and the pinion, thus expanding the tapered sleeve to generate the correct amount of force to hold the roll in place. The torque applied is isolated by the tapered sleeve removal and torque isolation ring that is an integral part of the roll assembly and interfaces with the roll mounting system to prevent any torque load from being transmitted to the robot arm via the roll mounting system during operation.

Figure 1B:
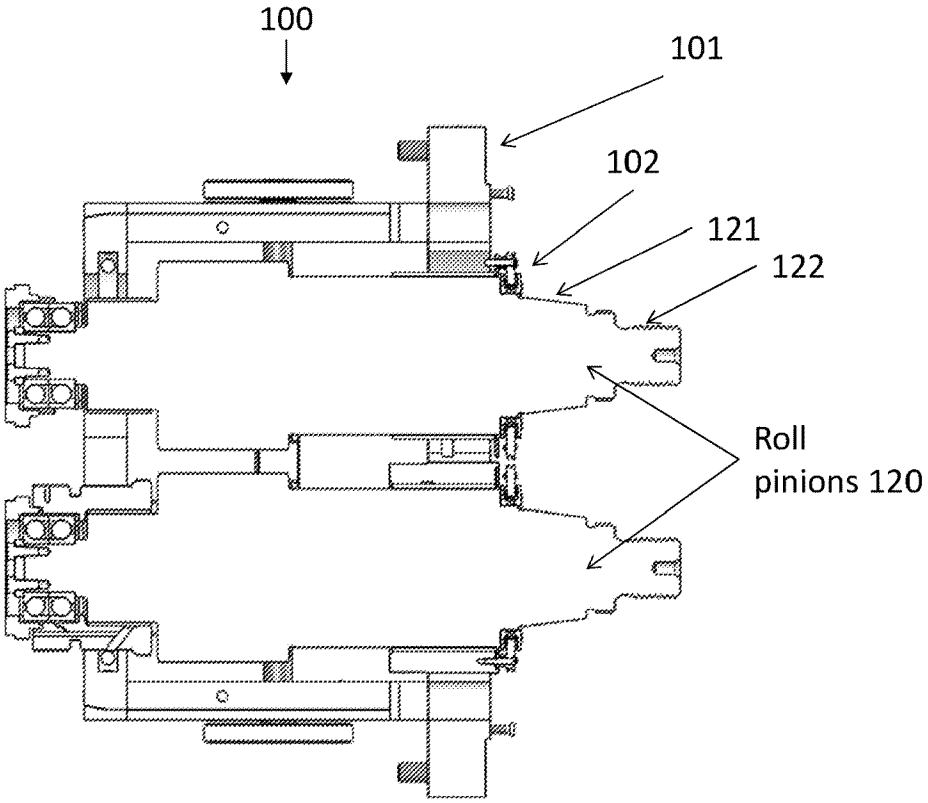
FIG. 1A-1B are schematic diagrams illustrating different views of a roll housing, without roll assemblies, in accordance with some embodiments.
Figure 1A:
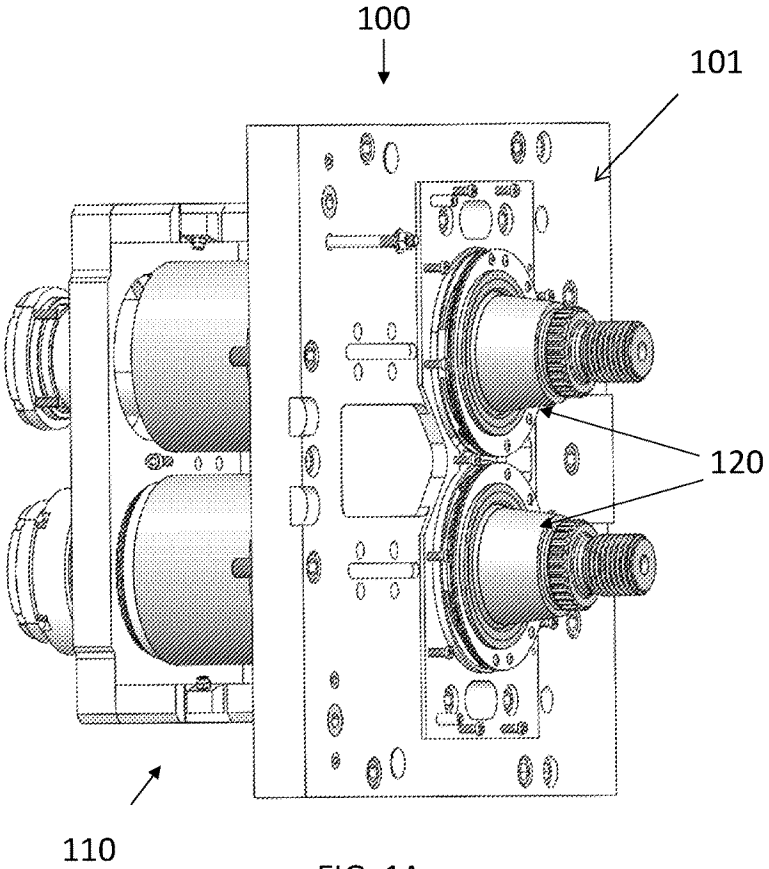

FIG. 1A is a schematic diagram perspective view of a roll housing 100 with main components of a roll housing structure 110 and roll pinions 120. The housing structure includes a front plate 101 and a flinger 102.

FIG. 1B is a schematic diagram cross-sectional view of a roll housing 100 showing the internal arrangement of the roll pinions 120 in the roll housing. Important features of the roll pinions are a tapered area 121 and a threaded area 122.

Figure 2B:
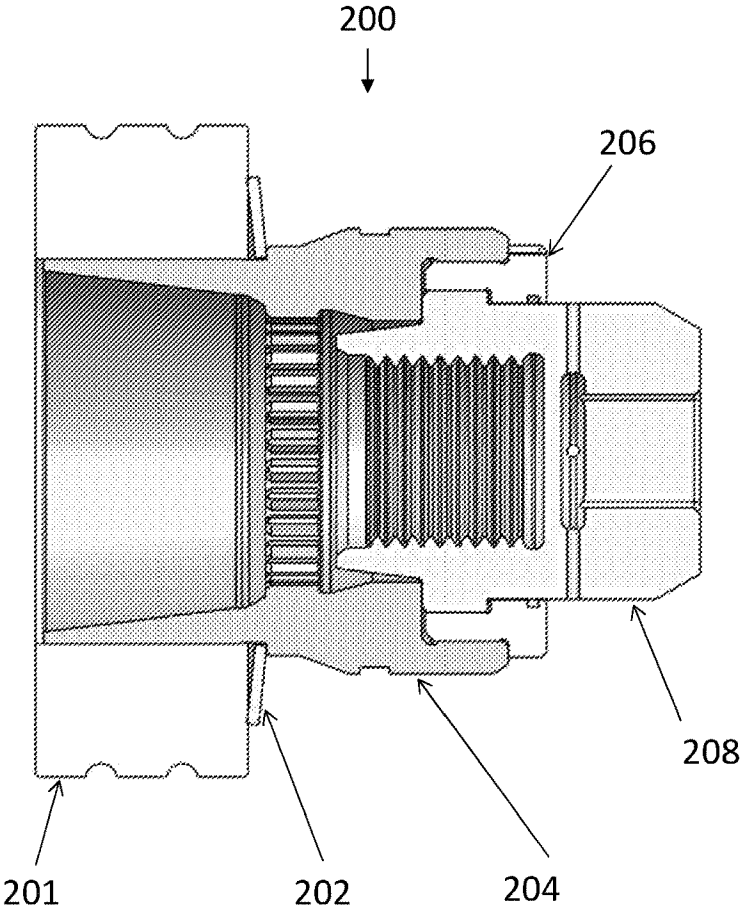
FIG. 2A-2B are schematic diagrams of a roll assembly to be used in a roll mounting system, in accordance with some embodiments.
Figure 2A:
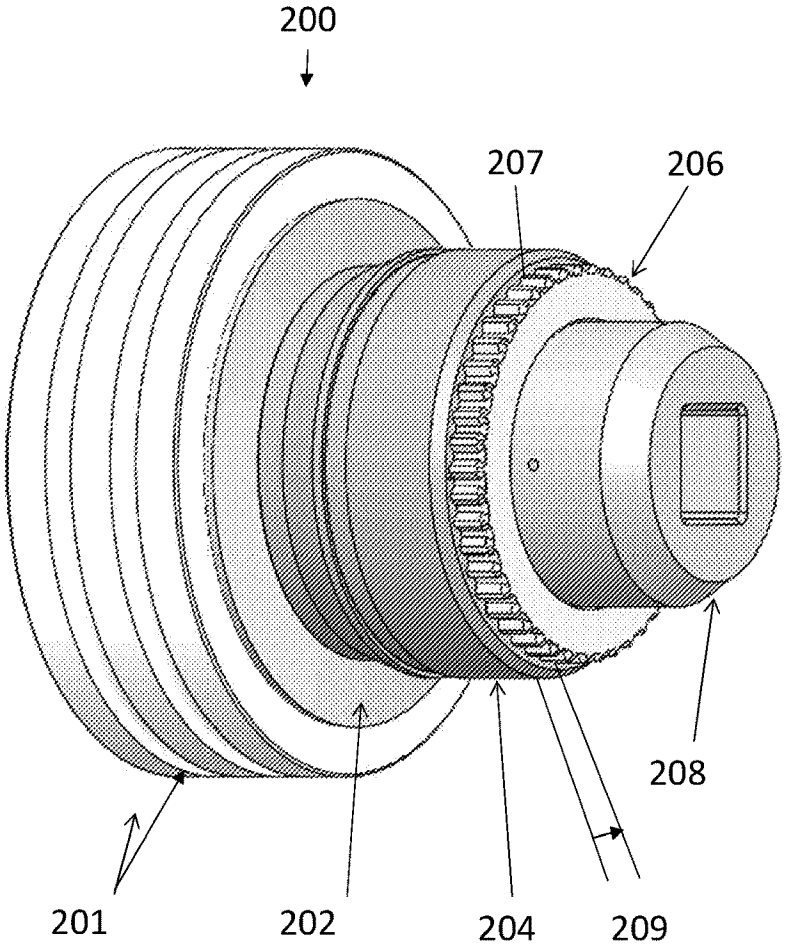

FIG. 2A is a schematic diagram perspective view of a roll assembly 200 with main components of a grooved roll 201 for shaping a hot metal workpiece, a spring 202, a tapered sleeve 204, a tapered sleeve removal and torque isolation ring 206, and a locking/unlocking nut 208. The tapered sleeve removal and torque isolation ring 206 includes a splined area for engagement with the combination tool. The locking/unlocking nut 208 includes a recessed cavity for engagement with a combination tool for supplying torque to the nut 208.

FIG. 2B is a schematic diagram cross-sectional view of a roll assembly 200 showing the internal arrangement of the assembly. Important features of the arrangement include the spring 202 between the tapered sleeve 204 and the roll 201, which acts to put the roll 201 against the flinger on the roll housing before the tapered sleeve 204 is fully engaged with the roll pinion, the taper on the tapered sleeve 204, which matches the taper angle of the roll pinion; splines 207 on the tapered sleeve 204 that engage with matching splines on the roll pinion; splines 207 on the tapered sleeve removal and torque isolation ring 206 that engage with matching splines in the specialized tool; internal threads on the locking/unlocking nut 208 that engage with matching threads on the end of the roll pinion.

In some embodiments, the tapered sleeve includes a taper angle 209 in a range of 6-12 degrees to allow a lower force used during removal of a roll. This tapered sleeve is an integrated component of a larger system and not a stand-alone part.

Another aspect is the significant improvement to the tapered sleeve design. The new sleeve has a steeper angle on the surface that mates with the roll pinion. The steeper angle results in less sliding wear on the sleeve and pinion. The steeper angle is mainly because the new system maintains a constant axial force on the sleeve, imposed by the locking nut. The present system with a shallow angle relies on the sleeve being forced onto the pinion by the roll mounting tool, expanding the sleeve and thus pushing radially on the roll, relying on the resulting friction to provide torque-carrying capacity to the stand. The force used for mounting needs to be limited, since the same sleeve must be pulled off of the pinion during roll change.

During the removal process, there is a high risk of breaking the "ears" of the tapered sleeve by using a large removal force. The current sleeve design is a bayonet style, such that the ears that engage with the removal tool are less than 180° of the circumference of the sleeve. The new sleeve with the steeper angle can be mounted with a larger force (imposed by the locking nut), with that larger force constantly applied after mounting, since the locking nut stays in position. In removal, the part of the tapered sleeve on which the removal force is applied is a continuous ring around the periphery of the sleeve, so the force is distributed, greatly reducing the risk of breakage. Also, since a larger force can be applied to the tapered sleeve, the torque capacity of the stand is increased due to the increased expansion of the sleeve against the roll.

Figure 3B:
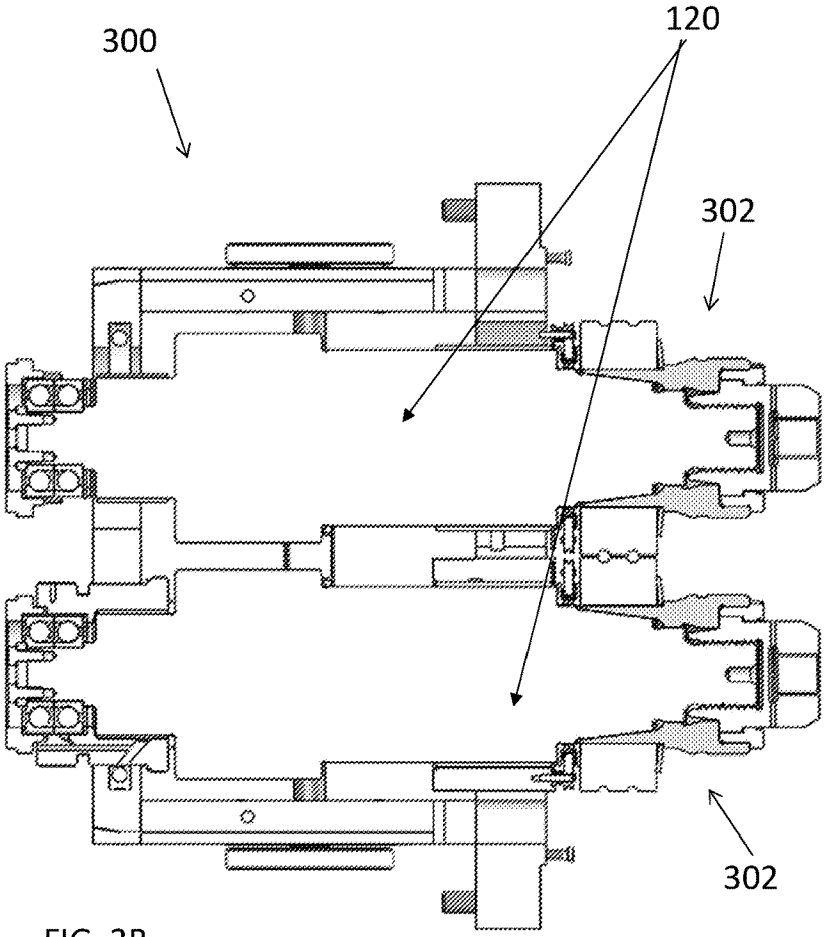
FIG. 3A-3B are schematic diagrams of a roll housing with mounted roll assemblies to be used in a roll mounting system, in accordance with some embodiments.
Figure 3A:
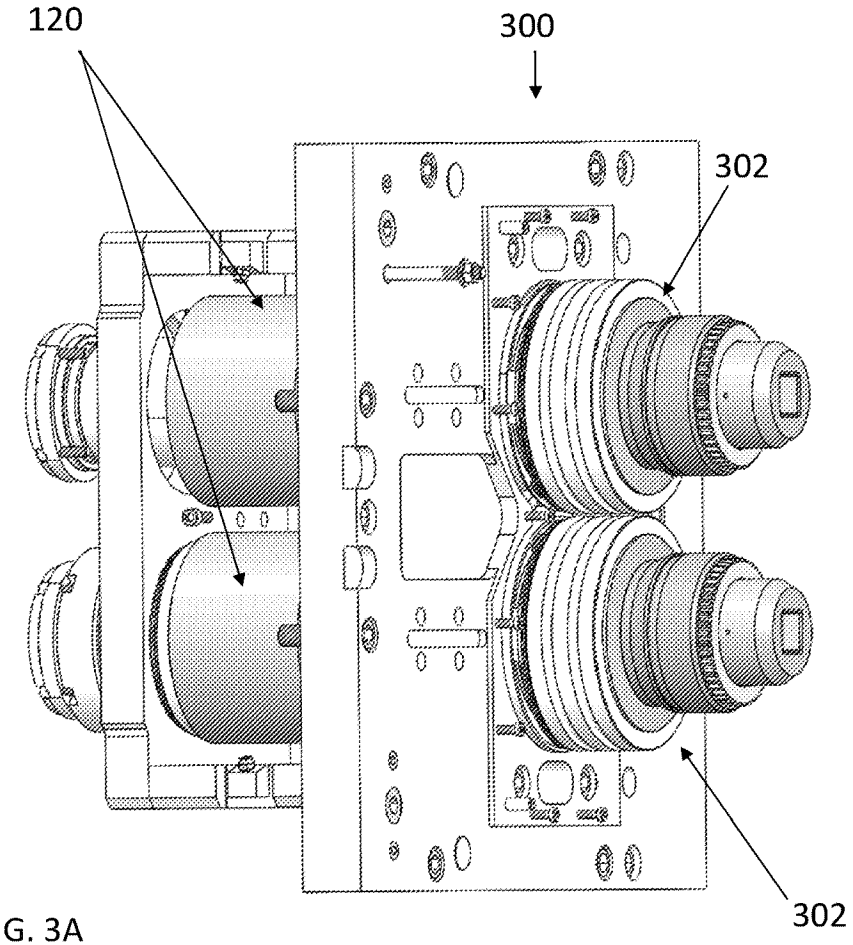

FIG. 3A is a schematic diagram perspective view of a roll housing 300 with roll assemblies 302 attached to each of the roll pinions 120, showing how the grooves in the rolls are aligned so that a metal workpiece is formed into the shape of the groove as it passes between the rolls.

FIG. 3B is a schematic diagram cross-sectional view of a roll housing 300 with roll assemblies 302 mounted to each of the roll pinions 120, showing the internal arrangement of the roll housing and the roll assemblies. Important features evident in in FIG. 3B are the contact of the roll with the flinger on the housing 300, having been forced into contact by the spring 202, and engaging of the tapered sleeve 204 with the tapered area of the roll pinion 120.

Figure 4B:
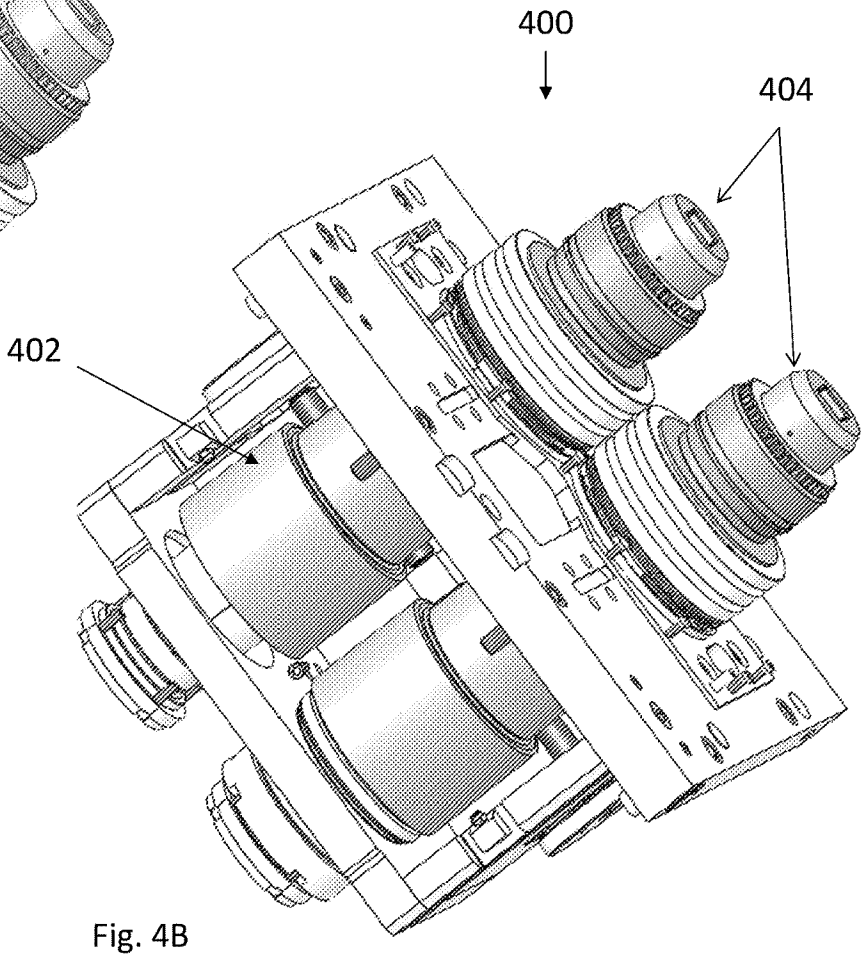
FIG. 4A-4B are schematic diagrams of a roll housing with a roll assembly to be mounted and a roll housing with two roll assemblies mounted by the roll mounting system, in accordance with some embodiments.
Figure 4A:
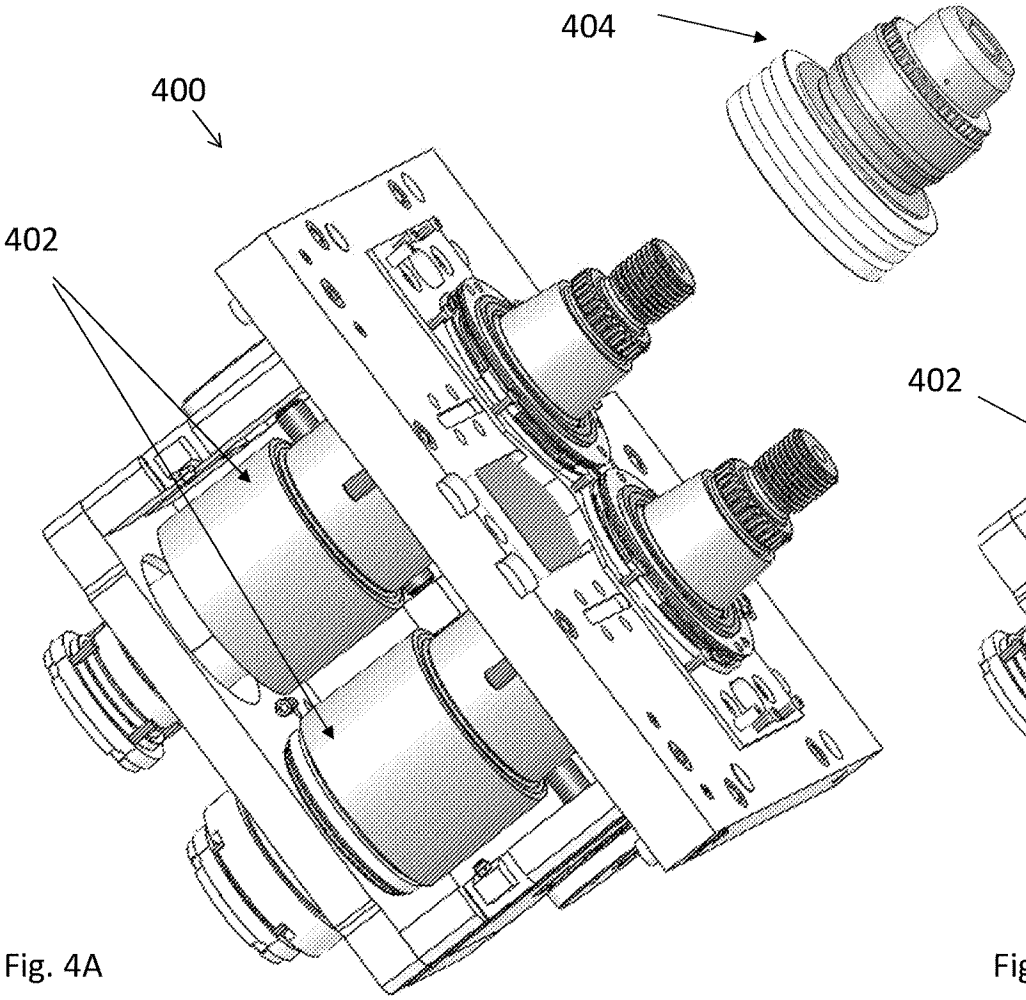

FIG. 4A is a schematic diagram perspective view of a roll housing 400 with the axes of rotation of the roll pinions 402 oriented generally at a 45° angle from the horizontal as typically used in a rolling mill, without roll assemblies attached, but with one roll assembly 404 oriented coaxially with one of the roll pinions 402 as it would be just before mounting the roll assembly 404 onto the roll pinion 402.

FIG. 4B is a schematic diagram perspective view of a roll housing 400 with the axes of rotation of the roll pinions 402 oriented generally at a 45° angle from the horizontal as typically used in a rolling mill, with roll assemblies 404 attached to the roll pinions 402.

Figures 5A, 5B:
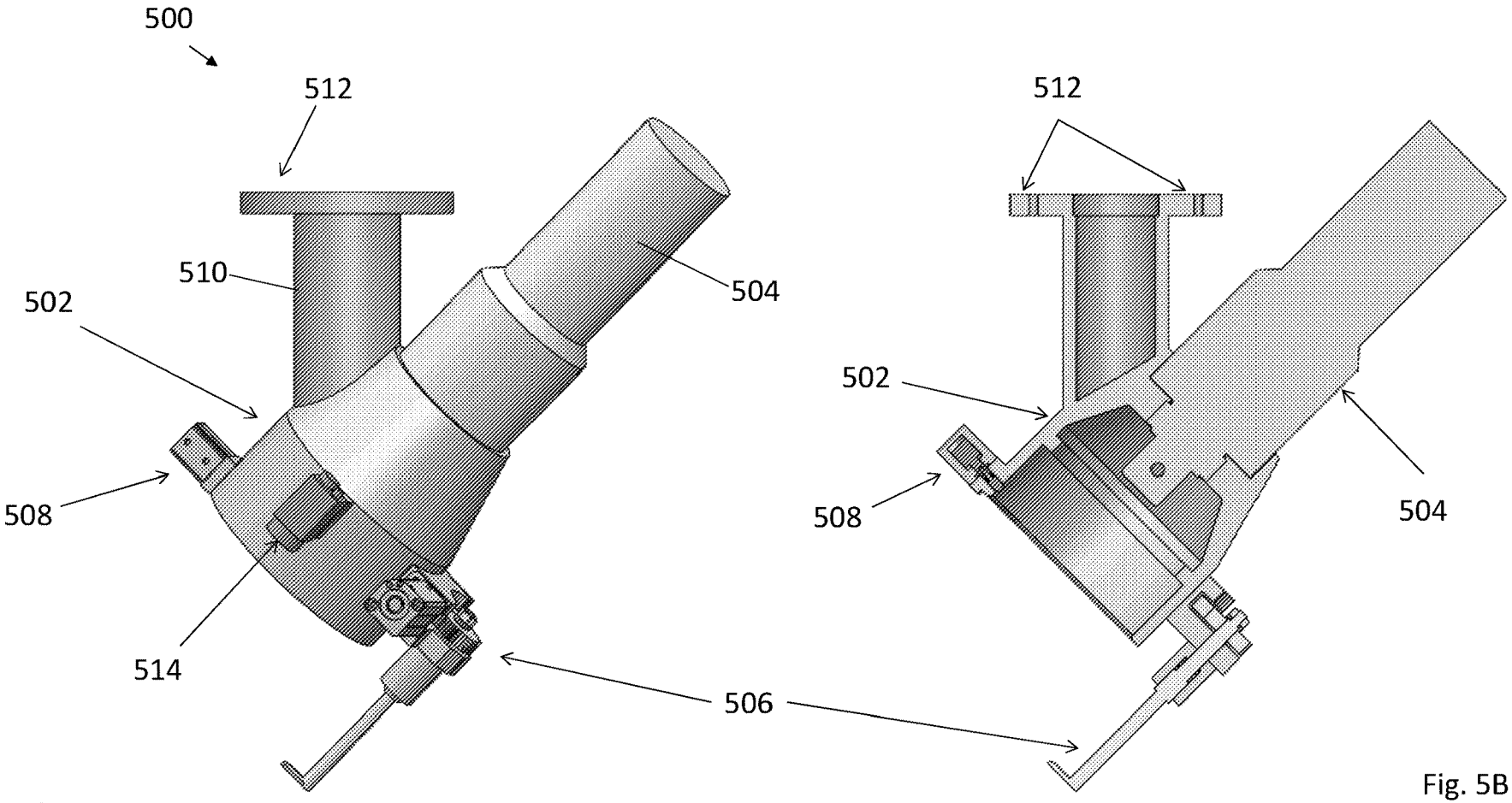
FIG. 5A-5B are schematic diagrams of a roll combination tool to be used for mounting or removing a roll assembly in a roll mounting system, in accordance with some embodiments.

FIG. 5A is a schematic diagram perspective view of a roll combination tool 500 without a roll assembly to be used for mounting and removing roll assemblies from the roll pinions. The roll combination tool 500 includes a roll assembly holder 502 that is coupled to a roll assembly. The roll combination tool 500 includes a power wrench 504 to supply torque. The power wrench 504 engages with the locking/unlocking nut 208 of FIG. 2. The roll combination tool 500 includes a means to turn the power wrench 504 to provide torque to the tapered sleeve removal and torque isolation ring 206 to isolate the robotic arm or manipulator from torque while the locking/unlocking nut 208 pushes the tapered sleeve 204 onto a pinion or unfastens a tapered sleeve 204 from a pinion during the removal of a roll. A roll assembly is configured to be mounted onto a corresponding roll pinion.

A roll holding mechanism 506 is attached to the tool holder 502 and is used to provide support to the roll assembly when the roll assembly is picked up by the roll combination tool 500. A tapered sleeve holding mechanism 508 is attached to the combination tool 502 and is used to provide support to the tapered sleeve 204 when the roll assembly is picked up by the roll combination tool 500. The locking/unlocking nut 208 is configured to push the tapered sleeve 204 on to a pinion when introduced to the rolling shaft. A tubular or other structure 510 is coupled to the roll tool holder 502. The tubular or other structure 510 is coupled to a mounting flange 512. The mounting flange 512 can be connected to a robotic arm or the like.

FIG. 5B is a schematic diagram cross-sectional view of a roll combination tool 500 without a roll assembly to be used for mounting and removing roll assemblies from the roll pinions, showing a mounting flange 512 for connection to a robot, a tapered sleeve holding mechanism 508, a roll holding mechanism 506, and a power wrench 504.

Figure 6B:
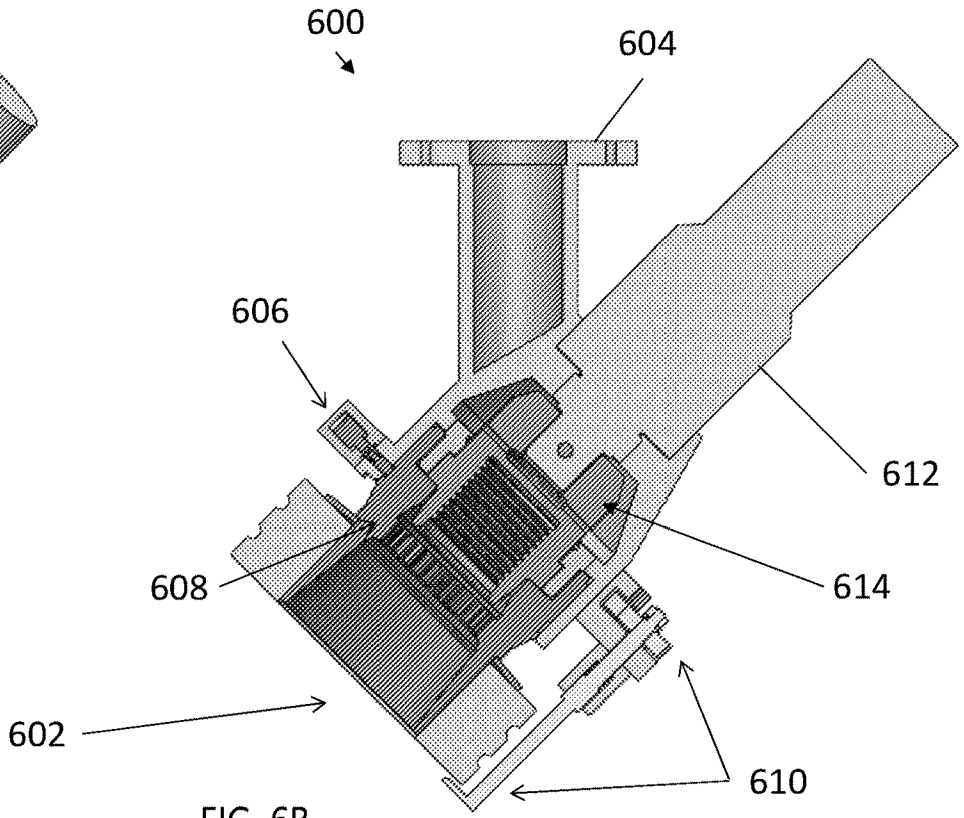
FIG. 6A-6B are schematic diagrams of a roll combination tool together with a roll assembly in a roll mounting system, in accordance with some embodiments.
Figure 6A:
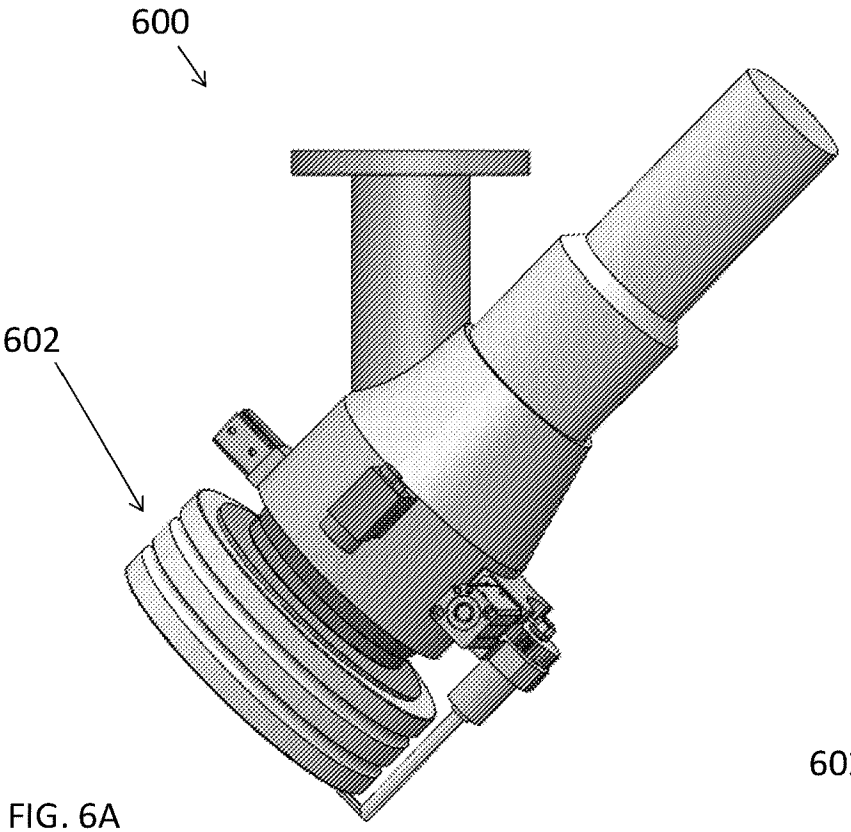

FIG. 6A is a schematic diagram perspective view of a roll combination tool 600 as shown in FIGS. 5A-5B to be used for mounting and removing roll assemblies from the roll pinions with a roll assembly 602.

FIG. 6B is a schematic diagram cross-sectional view of the roll combination tool 600 with the roll assembly 602 to be used for mounting and removing roll assemblies from the roll pinions. The roll combination tool 600 includes a mounting flange 604 for connection to a robotic arm or the like. A tapered sleeve holding mechanism 606 is in contact with the tapered sleeve 608 in the roll assembly 602. A roll holding mechanism 610 supporting a roll in the roll assembly 602, and a power wrench 612 engaged with a locking and unlocking nut 614 in the roll assembly 602.

Figure 7:
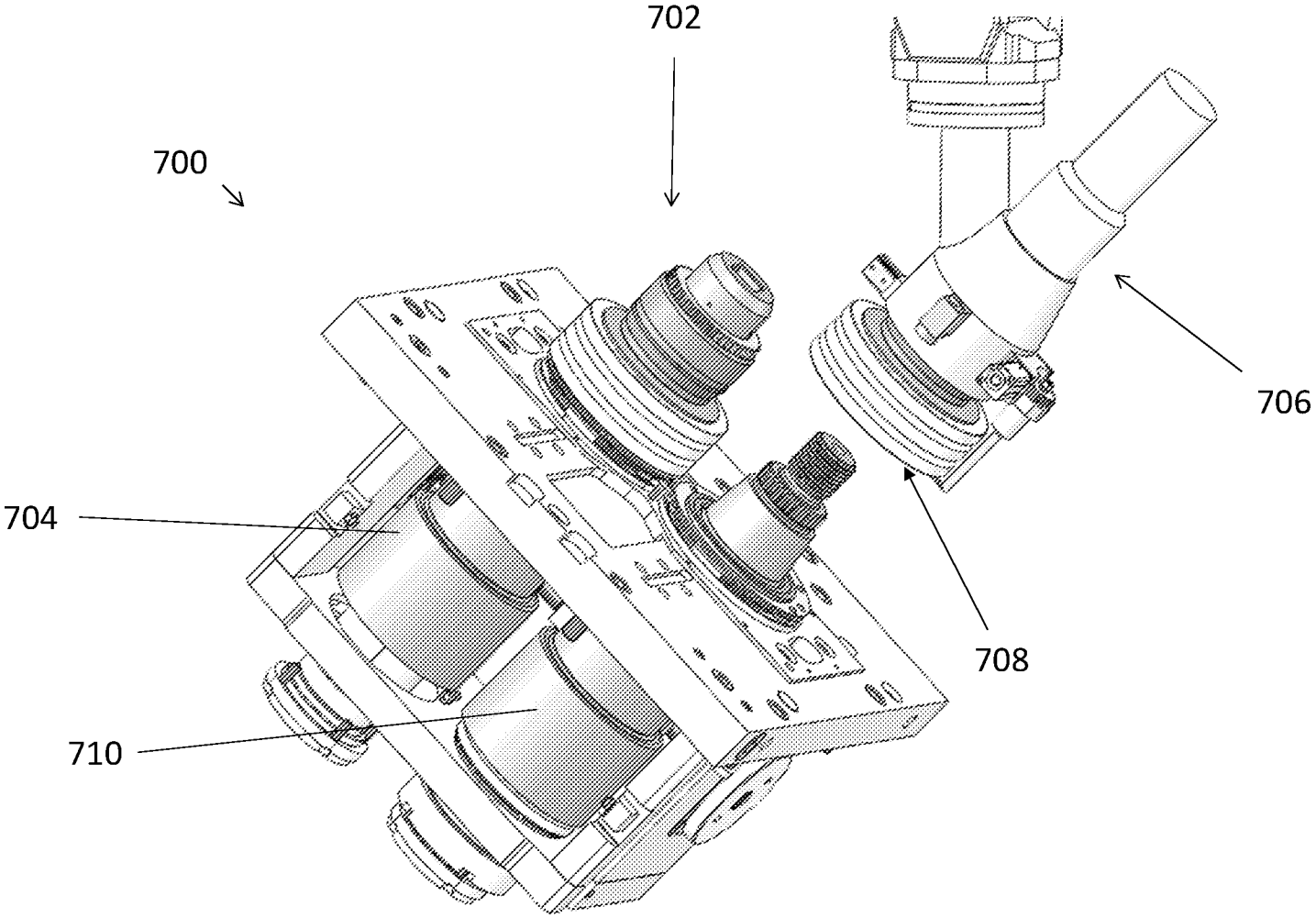
FIG. 7 is a schematic diagrams of a roll housing with one roll assembly mounted and a roll combination tool together with a roll assembly in a roll mounting system, in accordance with some embodiments.

FIG. 7 is a schematic diagram perspective view of a roll housing 700 with the axes of rotation of the roll pinions 704 and 710 oriented generally at a 45° angle from the horizontal as typically used in a rolling mill, with one roll assembly 702 attached to a roll pinion 704, and with a roll combination tool 706 holding a roll assembly 708 oriented coaxially with one of the roll pinions as it would be just before mounting the roll assembly 708 onto the roll pinion 710. The roll combination tool 706 is similar to roll combination tools 500 and 600 described in FIGS. 5A-5B and FIGS. 6A-6B.

Figure 8B:
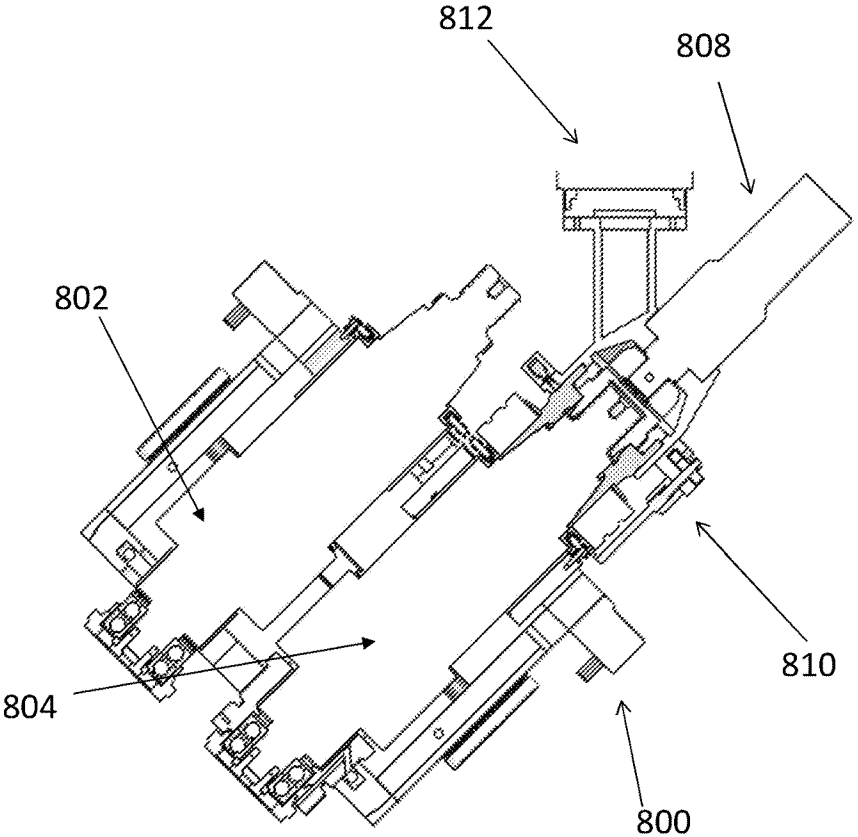
FIG. 8A-8B are schematic diagrams of a roll housing with one roll assembly mounted and a roll combination tool together with a roll assembly in a roll mounting system, in accordance with some embodiments.
Figure 8A:
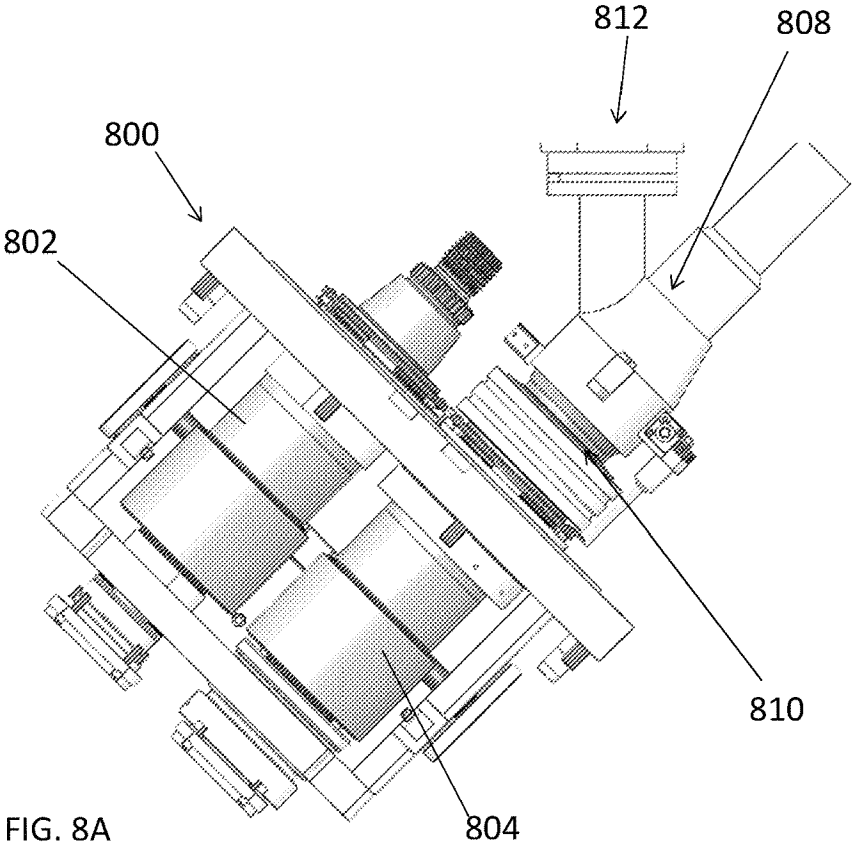

FIG. 8A is a schematic diagram of a roll housing 800 with the axes of rotation of the roll pinions 802, 804 oriented generally at a 45° angle from the horizontal as typically used in a rolling mill, with a roll combination tool 808 holding a roll assembly 810 positioned coaxially with one of the roll pinions 804 as it would be when mounting the roll assembly 810 onto the roll pinion 804 or prepared to remove the roll assembly 810 from the roll pinion 804. Roll combination tool 808 includes a mounting flange 812 for connection to a robotic arm or lifting tool. Also, roll combination tool 808 is similar to roll combination tools 500 and 600 described in FIGS. 5A-5B and FIGS. 6A-6B.

FIG. 8B is a schematic diagram cross-sectional view of a roll housing 800 with the axes of rotation of the roll pinions 802, 804 oriented generally at a 45° angle from the horizontal as typically used in a rolling mill, with roll combination tool 808 holding roll assembly 810 positioned coaxially with one of the roll pinions 804 as it would be when mounting roll assembly 810 onto the roll pinion 804 or prepared to remove roll assembly 810 from roll pinion 804.

Figure 9:
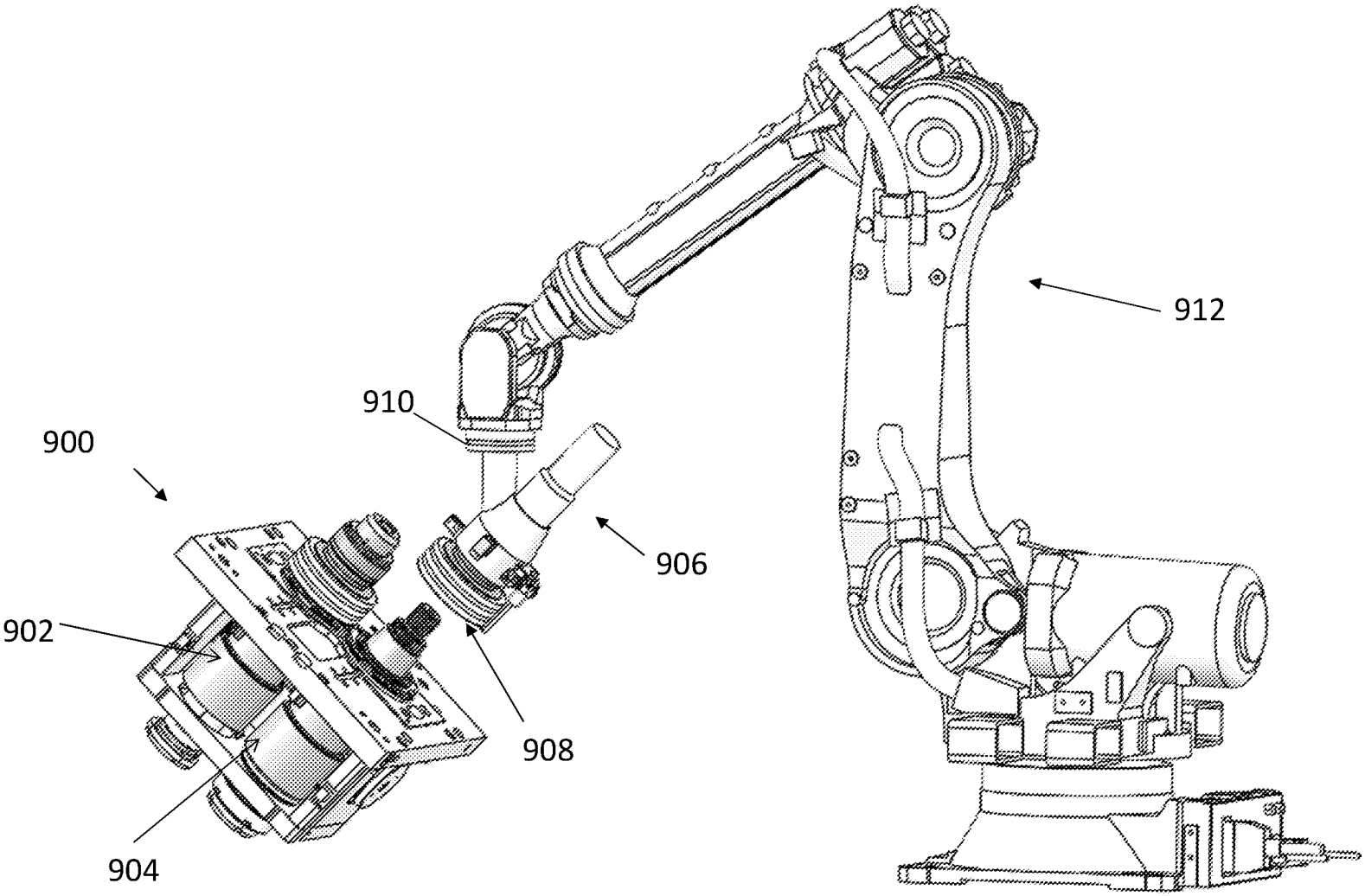
FIG. 9 is a schematic diagrams of one possible general arrangement of a roll housing with a roll mounting system on a robot, in accordance with some embodiments.

FIG. 9 is a schematic diagram perspective view of a roll housing 900 of a rolling mill, with the axes of rotation of the roll pinions 902, 904 oriented generally at a 45° angle from the horizontal as typically used in a rolling mill, with one roll assembly 908 held by a roll combination tool 906, in accordance with some embodiments, as it could be before mounting the roll assembly 908 onto the intended roll pinion 904 using a mounting flange 910 connected to a robotic arm or lifting tool 912. Also, roll combination tool 906 is similar to roll combination tools 500 and 600 described in FIGS. 5A-5B and FIGS. 6A-6B.

Figure 10:
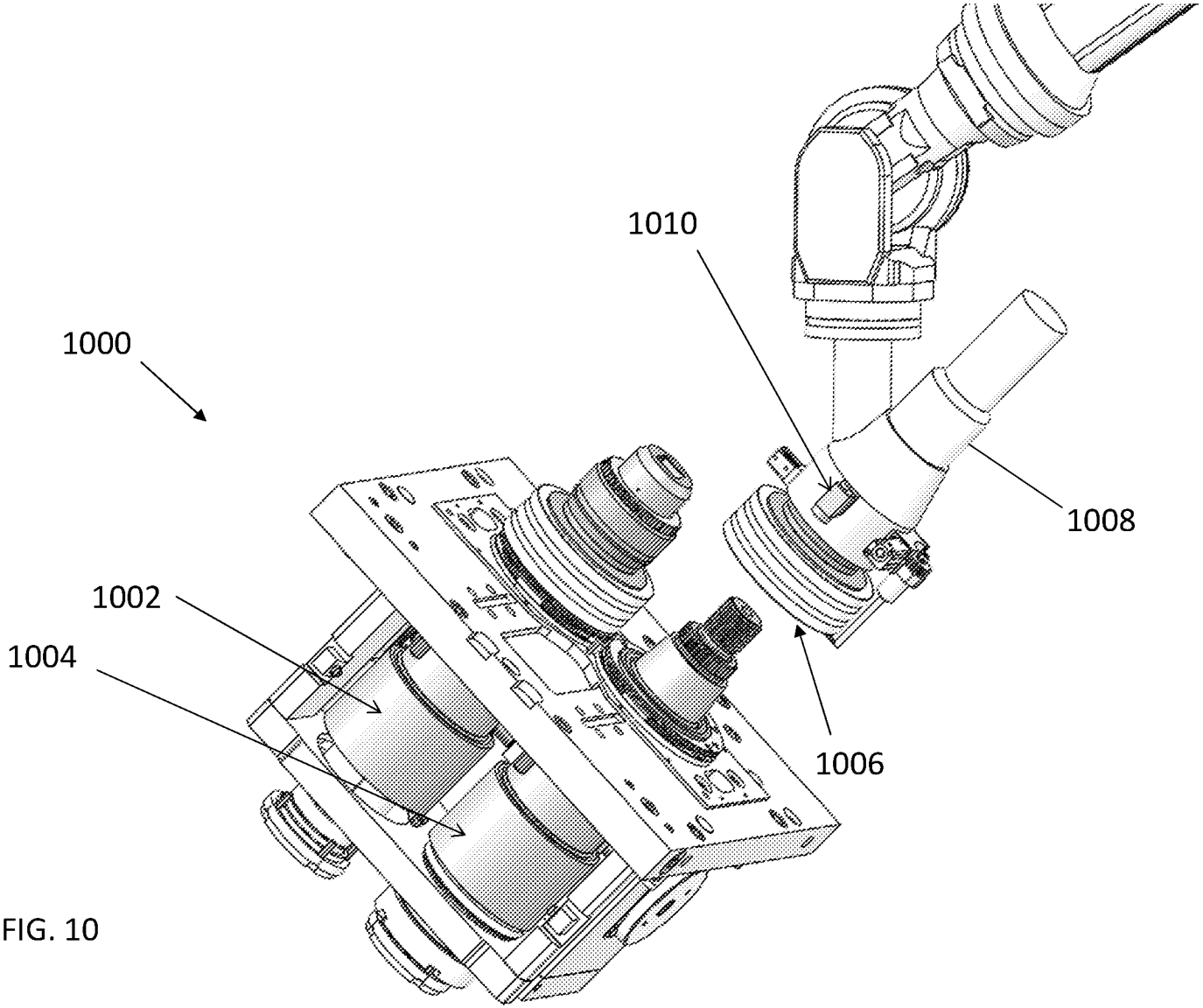
FIG. 10 is a schematic diagrams of one possible general arrangement of a roll housing with a roll mounting system on a robot, in accordance with some embodiments.

FIG. 10 is another view of a schematic diagram perspective view of a roll housing 1000 of a rolling mill, with the axes of rotation of the roll pinions 1002, 1004 oriented generally at a 45° angle from the horizontal as typically used in a rolling mill, with one roll assembly 1006 held by a roll combination tool 1008, in accordance with some embodiments, as it could be before mounting the roll assembly 1006 onto the intended roll pinion 1004. Also, roll combination tool 1008 is similar to roll combination tools 500 and 600 described in FIGS. 5A-5B and FIGS. 6A-6B.

In order to achieve the fully automated system, the roll mounting system necessitates the installation of new pinions to the rolling stands, however the existing pinions and any spare pinions in stock can be modified or re-worked and used. There are no changes to the existing rolling mill's inventory for the invention to operate but improvements can be made to roll inventories and scheduling with the inclusion of an RFID tag, to communicate to the robotic system of any changes to roll inventories and scheduling.

The invention simplifies existing handling, mounting, and removal of a roll using a novel roll mounting system. The novel roll mounting system utilizes a tapered sleeve assembly that allows for an easier mounting and removal with incurring significant size and weight. In some embodiments, the maximum force the tapered sleeve assembly can sustain is 98.8 mton. The torque capacity of the roll assembly is increased because of the larger force on the tapered sleeve. Due to the larger tapered angle of the tapered sleeve, the service life of the tapered sleeve assembly increases because there is less sliding wear between. Moreover, the invention does not necessarily require the use of hydraulics.

Although the present invention has been shown and described with respect to several preferred embodiments thereof, various changes, omissions and additions to the form and detail thereof, may be made therein, without departing from the spirit and scope of the invention.

What is claimed is:

1. A roll mounting system comprising:

a roll assembly coupled to one or more rolls, where the roll assembly is configured to position the one or more rolls using a tapered assembly for mounting or dismounting of the one or more rolls, wherein the rolling assembly comprises a torque nut coupled to the roll assembly; and a torque assembly coupled to the roll assembly, where the torque assembly is configured to provide torque to the roll assembly for mounting or dismounting of the one more rolls, wherein the torque nut pushes or applies a force to at least one tapered sleeve of the tapered assembly to create a locking force to mount the one or more rolls the tapered assembly comprises a torque isolation ring, the torque isolation ring counters a torque produced by the torque nut to prevent any torque load from being transmitted via the roll mounting system.

2. The roll mounting system of claim 1, wherein the at least one tapered sleeve comprises a tapered angle between 6 degrees and 12 degrees.

3. The roll mounting system of claim 1, wherein the tapered assembly comprise a plurality of splines integrally coupled to the tapered sleeves.

4. The roll mounting system of claim 3, wherein the splines mate with a pinion coupled to the roll assembly.

5. The roll mounting system of claim 1, wherein the torque nut pushes the at least one tapered sleeve of the tapered assembly on to a pinion.

6. The roll mounting system of claim 1, wherein the torque isolation ring is coupled to the torque assembly.

7. The roll mounting system of claim 6, wherein the torque isolation ring uses a torque received by the torque assembly to generate torque for mounting or dismounting the one or more rolls.

8. The roll mounting system of claim 1, wherein the one or more rolls are positioned on the at least one tapered sleeve of the tapered assembly.

9. A method of performing the operations of a roll mounting system comprising:

providing one or more rolls;

positioning the one or more rolls into a roll assembly, where the roll assembly is configured to position the one or more rolls using a tapered assembly for mounting or dismounting of the one or more rolls, wherein the rolling assembly comprises a torque nut coupled to the roll assembly; and coupling the roll assembly to a torque assembly, where the torque assembly is configured to provide torque to the roll assembly for mounting or dismounting of the one or more rolls, wherein the torque nut pushes or applies a force to at least one tapered sleeve of the tapered assembly to create a locking force to mount the one or more rolls, the tapered assembly comprises a torque isolation ring, the torque isolation ring counters a torque produced by the torque nut to prevent any torque load from being transmitted via the roll mounting system.

10. The method of claim 9, wherein the at least one tapered sleeve comprise a tapered angle between 6 degrees and 12 degrees.

11. The method of claim 9, wherein the tapered assembly comprise a plurality of splines integrally coupled to the at least one tapered sleeve.

12. The method of claim 11, wherein positioning the one or more rolls into the roll assembly comprises mating the splines mate with a pinion coupled to the roll assembly.

13. The method of claim 9, wherein coupling the roll assembly to the torque assembly comprises pushing, using the torque nut, the at least one tapered sleeve of the tapered assembly on to a pinion.

14. The method of claim 9, wherein coupling the roll assembly to the torque assembly comprises coupling the torque isolation ring to the torque assembly.

15. The method of claim 14, wherein coupling the roll assembly to the torque assembly comprises using, by the torque isolation ring, a torque received by the torque assembly to generate torque for mounting or dismounting the one or more rolls.

16. The method of claim 9, wherein coupling the roll assembly to the torque assembly comprises positioning the one or more rolls on at least one tapered sleeve of the tapered arrangement.

* * * * *